US007482046B2

(12) United States Patent
Williams et al.

(10) Patent No.: US 7,482,046 B2
(45) Date of Patent: Jan. 27, 2009

(54) CUT RESISTANT PAPER AND PAPER ARTICLES AND METHOD FOR MAKING SAME

(75) Inventors: Richard C Williams, Middletown, NY (US); Peter M Froass, Chester, NY (US); David A Boone, Germantown, TN (US); Richard D Faber, Memphis, TN (US)

(73) Assignee: International Paper Company, Memphis, TN (US)

( * ) Notice: Subject to any disclaimer, the term of this patent is extended or adjusted under 35 U.S.C. 154(b) by 650 days.

(21) Appl. No.: 10/967,074

(22) Filed: Oct. 15, 2004

(65) Prior Publication Data

US 2005/0098286 A1 May 12, 2005

Related U.S. Application Data

(60) Division of application No. 10/121,301, filed on Apr. 11, 2002, now Pat. No. 6,866,906, which is a continuation-in-part of application No. 09/770,340, filed on Jan. 26, 2001, now Pat. No. 6,802,938.

(60) Provisional application No. 60/178,214, filed on Jan. 26, 2000, provisional application No. 60/282,983, filed on Apr. 11, 2001.

(51) Int. Cl.

| | |
|---|---|
| ***B29D 22/00*** | (2006.01) |
| ***B29D 23/00*** | (2006.01) |
| ***B32B 1/08*** | (2006.01) |
| ***B65D 27/00*** | (2006.01) |

(52) U.S. Cl. ..... 428/34.2; 428/35.6; 428/332; 428/342; 428/402.21; 162/231; 229/67.1

(58) Field of Classification Search ..... 428/34.2, 428/34.3, 35.6, 532, 537.1, 537.5, 213, 218, 428/219, 220, 340, 341, 342, 332, 402.21, 428/401; 162/158, 231; 229/67.1
See application file for complete search history.

(56) References Cited

U.S. PATENT DOCUMENTS 3,293,114 A 12/1966 Kenaga et al.

(Continued)

FOREIGN PATENT DOCUMENTS

EP 0498372 8/1991

(Continued)

OTHER PUBLICATIONS

Tappi/May 1972, vol. 55, No. 5, p. 770-771.

(Continued)

*Primary Examiner*—Michael C Miggins
(74) *Attorney, Agent, or Firm*—Thomas W. Barnes, III; Richard C. Stewart, II; Luedeka, Neely & Graham, P.C.

(57) ABSTRACT

The specification discloses a method for making a paper material having a reduced tendency to cut human skin. The method includes providing a papermaking furnish containing cellulosic fibers and from about 0.5 to about 5.0 wt % by weight dry basis expandable microspheres, forming a paperboard web from the papermaking furnish, drying the web, and calendaring the web to a caliper of from about 11.0 to about 18.0 mils and a density ranging from about 7.0 to about 12.0 lb/3000 $ft^2$/mil. Papers formed according to the method and articles formed therefrom are also disclosed.

34 Claims, 5 Drawing Sheets

U.S. PATENT DOCUMENTS 3,357,322 A 12/1967 Gill
3,468,467 A 9/1969 Amberg
3,533,908 A 10/1970 Hoogsteen
3,556,394 A 1/1971 Caldes et al.
3,556,934 A 1/1971 Meyer
3,615,972 A 10/1971 Morehouse et al.
3,779,951 A 12/1973 Streu
3,785,254 A 1/1974 Mann
3,819,470 A 6/1974 Shaw et al.
3,941,634 A * 3/1976 Nisser et al. ..... 156/79
4,040,900 A 8/1977 Massarella et al.
4,051,277 A 9/1977 Wilkinson et al.
4,133,688 A 1/1979 Sack
4,179,546 A 12/1979 Garner et al.
4,233,325 A 11/1980 Slangan et al.
4,237,171 A 12/1980 Laage et al.
4,241,125 A 12/1980 Canning et al.
4,279,794 A 7/1981 Dumas
4,324,753 A 4/1982 Gill
4,435,344 A 3/1984 Iioka
4,451,585 A 5/1984 Andersson
4,477,518 A 10/1984 Cremona et al.
4,483,889 A * 11/1984 Andersson ..... 427/389.9
4,548,349 A 10/1985 Tunberg
4,581,285 A 4/1986 Mahefkey, Jr.
4,617,223 A 10/1986 Hiscock et al.
4,619,734 A 10/1986 Andersson
4,777,930 A 10/1988 Hartz
4,781,243 A 11/1988 DeVogel et al.
4,836,400 A 6/1989 Chaffey et al.
4,898,752 A 2/1990 Cavagna et al.
4,902,722 A 2/1990 Melber
4,946,737 A 8/1990 Lindeman et al.
4,952,628 A 8/1990 Blatz
4,977,004 A 12/1990 Bettle, III et al.
4,982,722 A 1/1991 Wyatt
4,988,478 A 1/1991 Held
5,029,749 A 7/1991 Aloisi
5,092,485 A 3/1992 Lee
5,096,650 A 3/1992 Renna
5,102,948 A 4/1992 Deguchi et al.
5,125,996 A 6/1992 Campbell et al.
5,145,107 A 9/1992 Silver et al.
5,155,138 A 10/1992 Lundqvist
5,226,858 A 7/1993 Snowdon
5,342,649 A 8/1994 Sarokin
5,363,982 A 11/1994 Sadlier
5,370,814 A 12/1994 Salyer
5,424,519 A 6/1995 Salee
5,454,471 A 10/1995 Norvell
5,477,917 A 12/1995 Salyer
5,478,988 A 12/1995 Hughes et al.
5,490,631 A 2/1996 Iioka et al.
5,499,460 A 3/1996 Bryant et al.
5,514,429 A 5/1996 Kamihgaraguchi et al.
5,520,103 A 5/1996 Zielinski et al.
5,601,744 A 2/1997 Baldwin
5,637,389 A 6/1997 Colvin et al.
5,685,068 A 11/1997 Bankestrom et al.
5,700,560 A 12/1997 Kotani et al.
5,705,242 A 1/1998 Andersen et al.
5,759,624 A 6/1998 Neale et al.
5,792,398 A 8/1998 Andersson
5,800,676 A 9/1998 Koike et al.
5,880,435 A 3/1999 Bostic
5,884,006 A 3/1999 Frohlich et al.
6,042,936 A 3/2000 Kempf
6,133,170 A 10/2000 Suenga et al.
6,267,837 B1 7/2001 Mitchell et al.
6,308,883 B1 10/2001 Schmelzer et al.
6,379,497 B1 * 4/2002 Sandstrom et al. ..... 162/123
6,391,154 B1 5/2002 Nyg.ang.rd et al.
6,391,943 B2 5/2002 Sarma et al.
6,406,592 B2 6/2002 Leskela et al.
6,592,983 B1 7/2003 Carson et al.
6,740,373 B1 5/2004 Swoboda et al.
6,802,938 B2 10/2004 Mohan et al.
6,846,529 B2 1/2005 Mohan et al.
6,919,111 B2 7/2005 Swoboda et al.
2001/0038893 A1 11/2001 Mohan et al.
2001/0046574 A1 11/2001 Curtis
2002/0148832 A1 10/2002 Breining et al.
2003/0003268 A1 1/2003 Williams et al.
2003/0152724 A1 8/2003 Swoboda et al.
2004/0052989 A1 3/2004 Mohan et al.
2004/0065424 A1 4/2004 Mohan et al.
2004/0197500 A9 10/2004 Swoboda et al.
2004/0209023 A1 10/2004 Swoboda et al.
2005/0112305 A1 5/2005 Swoboda et al.
2005/0133183 A1 6/2005 Mohan et al.

FOREIGN PATENT DOCUMENTS

EP 0486080 5/1992
EP 0596750 5/1994
EP 0598372 5/1994
EP 0629741 12/1994
EP 0666368 8/1995
GB 786543 11/1957
GB 903416 8/1962
GB 1373788 11/1974
GB 1533434 11/1978
GB 2307487 5/1997
JP 26698767 10/1997
WO WO 9947681 9/1999
WO WO 01/24988 8/2001
WO WO 02/084026 10/2002

OTHER PUBLICATIONS

Tappi/Dec. 1973, vol. 56, No. 12, p. 158-160.
"The Use of Microspheres to Improve paper Properties", by Soderberg, Paper Technology, Aug. 1989, pp. VIII/17-VII/21.
"Xpancel", An Introduction, a publication from Expancel, Box 13000, S0-850 13 Sudsvall, Sweden, Date Unknown.
"The Application of Microspheres for the Production of High Bulk Papers", by M. Baumeister, Das Papier, vol. 26, No. 10A: 716-720 (1972).
"Microspheres find use as fiber replacement in low-density board", by David O. Bowen, Pulp & Paper Nov. 1976, p. 126-127.
Expancel Expandable Microspheres in Paper and Board, by Mark Lunabba, KemaNord Plast AB, Sector Microspheres, Box 13000, S-850 13 Sundsvall, Sweden, Date Unknown.
"Expandable Microspheres in Board", World Pulp & Paper Technology, pp. 143-145, Date Unknown.
"Foams on the Cutting Edge", by Ray Erikson, Jan. 1999.

* cited by examiner

CUT RESISTANT PAPER AND PAPER ARTICLES AND METHOD FOR MAKING SAME

This application claims priority to and is a Divisional Application of U.S. application Ser. No. 10/121,301, filed Apr. 11,2002 now U.S. Pat. No. 6,866,906, which is a Continuation-In-Part Application of U.S. application Ser. No. 09/770,340, filed Jan. 26, 2001, now U.S. Pat. No. 6,802,938, which claims the benefit of priority to U.S. application Ser. No. 60/178,214, filed Jan. 26, 2000, all of which are also hereby incorporated, in their entirety, herein by reference. U.S. application Ser. No. 10/121,301, filed Apr. 11, 2002, also claims the benefit of priority to U.S. application Ser. No. 60/282,983, filed Apr. 11, 2001, which is also hereby incorporated, in its entirety, herein by reference.

FIELD OF THE INVENTION

The invention relates to the papermaking arts and, in particular, to the manufacture of paper products such as file folders and the like made of relatively heavy weight paper a/k/a paperboard for use in office and clerical environments.

BACKGROUND OF THE INVENTION

The contemporary work office uses a myriad of paper products including, but not limited to, writing papers, notepads, and file folders and/or jackets to organize and store various paperwork. Such file folders and/or jackets (hereinafter referred to collectively as "folders") are typically made using a paper material which is rather stiff and durable so as to protect the contents of the file and to stand upright or remain relatively flat and self-supporting. Unfortunately, such products also typically have edges which have a tendency to inflict so called "paper cuts" upon personnel handling the files. While rarely presenting a case of serious injury, paper cuts are nonetheless an inconvenience and may cause considerable discomfort as such cuts are often jagged and irregular and formed across the highly sensitive nerve endings of the fingers.

Accordingly, there exists a need for improved paper products, and in particular paper based file folders, which reduce or eliminate paper cuts.

SUMMARY OF THE INVENTION

With regard to the foregoing and other objects and advantages, the present invention provides a method for making a paper material having a reduced tendency to cut human skin and tissue. The method includes providing a papermaking furnish including cellulosic fibers, from about 0.5 to about 5.0 wt % by weight dry basis expanded or expandable microspheres, and, optionally, conventional furnish additives including fillers, retention aids, and the like, forming a fibrous web from the papermaking furnish, drying the web, and calendaring the web to a caliper of from about 11.0 to about 18.0 mils and a density ranging from about 7.0 to about 12.0 lb/3000 $ft^2$/mil.

In another aspect, the invention relates to a paper material for use in the manufacture of paper articles such as file folders. The paper material includes a paper web including cellulosic fibers and expanded microspheres dispersed within the fibers and, optionally, conventional paper additives including one or more fillers and starches. The paper web has a density of from about 7.0 to about 12.0 lb/3000 $ft^2$/mil and a caliper of from about 11.0 to about 18.0 mils. In addition, the paper web has edges which exhibit an improved resistance to inflicting cuts upon human skin.

In still another aspect, the invention provides a file folder or jacket. The file folder of jacket comprises a paper web including wood fibers and expanded microspheres dispersed within the fibers. The paper web has a density of from about 7.0 to about 12.0 lb/3000 $ft^2$/mil and a caliper of from about 11.0 to about 18.0 mils. The paper web is die cut to provide exposed edges on the folder or jacket that exhibit improved resistance to inflicting cuts upon human skin.

In accordance with one preferred embodiment of the invention, the paper web has a density of from about 7.5 lb/3000 $ft^2$/mil to about 9.0 lb/3000 $ft^2$/mil. It is also preferred that the paper web have a caliper of about 14.0 to about 16.0 mils. The basis weight of the web is typically from about 80 lb/3000 $ft^2$ to about 300 lb/3000 $ft^2$, more preferably from about 120 lb/3000 $ft^2$ to about 150 lb/3000 $ft^2$.

Typically the microspheres in the paper web comprise synthetic polymeric microspheres and comprise from about 0.5 to about 5.0 wt. % of the total weight of the web on a dry basis, more preferably from about 1.0 wt % to about 2.0 wt % of the total weight of the web on a dry basis. It is particularly preferred that the microspheres comprise microspheres made from a polymeric material selected from the group consisting of methyl methacrylate, ortho-chlorostyrene, polyortho-chlorostyrene, polyvinylbenzyl chloride, acrylonitrile, vinylidene chloride, para-tert-butyl styrene, vinyl acetate, butyl acrylate, styrene, methacrylic acid, vinylbenzyl chloride and combinations of two or more of the foregoing. The microspheres have a preferred expanded diameter of from about 30 to about 60 microns. In addition, it may be preferred in some cases to initially disperse the microspheres in the furnish in an unexpanded state and subsequently expand the microspheres as the paper web dries.

The cellulosic fibers of the web may be provided from hardwoods, softwoods, or a mixture of the two. Preferably, the fibers in the paper web include from about 30% to about 100% by weight dry basis softwood fibers and from about 70% to about 0% by weight dry basis hardwood fibers.

BRIEF DESCRIPTION OF THE DRAWINGS

The above and other aspects and advantages of the invention will now be further described in conjunction with the accompanying drawings in which.

DETAILED DESCRIPTION OF THE INVENTION

Figure 1:
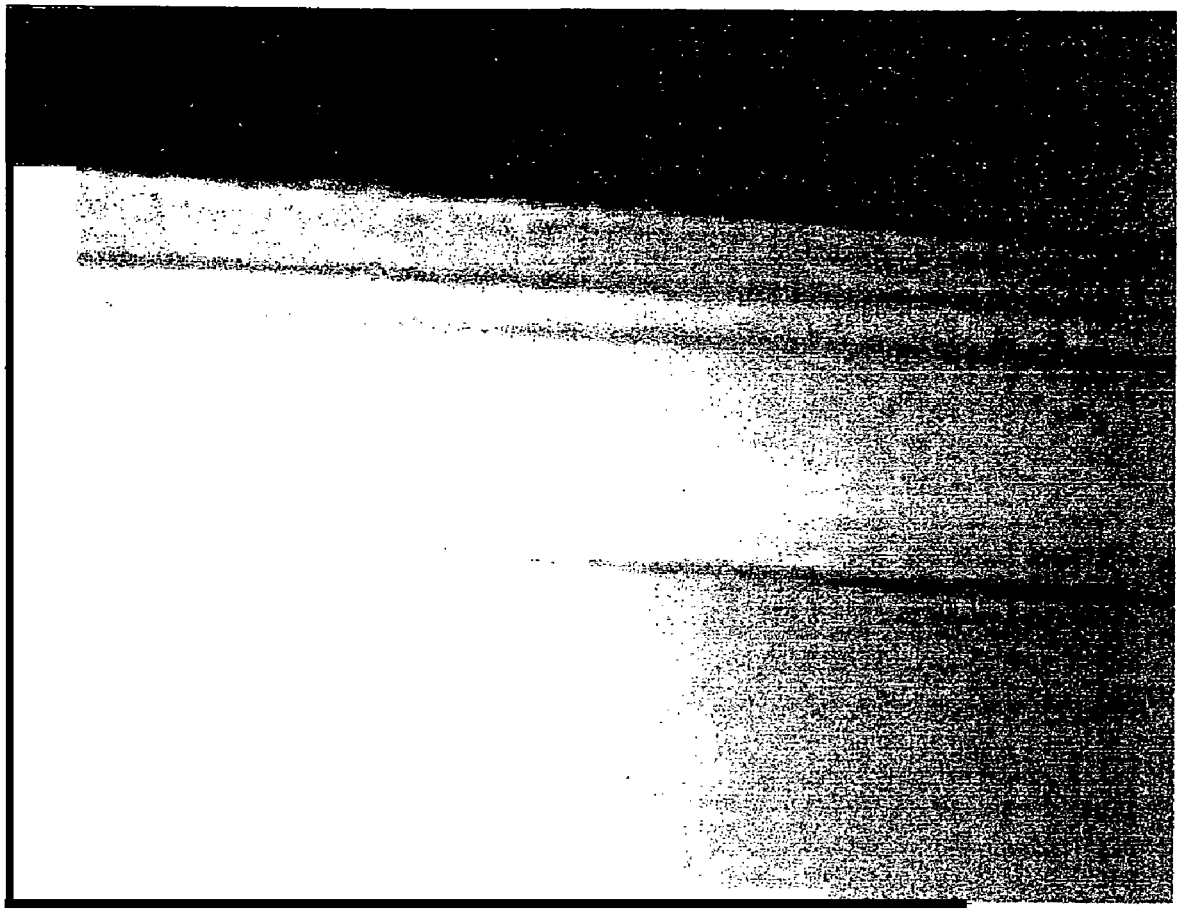
FIG. 1 is photomicrograph illustrating edges of conventional papers after being cut by various paper cutting techniques.

The invention provides a paper material having an improved cut resistance, i.e., the edges of the paper have a reduced tendency to cut, abrade, or damage human skin. As used herein, "paper" refers to and includes both paper and paperboard unless otherwise noted.

The paper is provided as a web containing cellulosic pulp fibers such as fiber derived from hardwood trees, softwood trees, or a combination of hardwood and softwood trees prepared for use in a papermaking furnish by any known suitable digestion, refining, and bleaching operations. In a preferred embodiment, the cellulosic fibers in the paper include from about 30% to about 100% by weight dry basis softwood fibers and from about 70% to about 0% by weight dry basis hardwood fibers. In certain embodiments, at least a portion of the fibers may be provided from non-woody herbaceous plants including, but not limited to, kenaf, hemp, jute, flax, sisal, or abaca although legal restrictions and other considerations may make the utilization of hemp and other fiber sources impractical or impossible. The paper may also include other conventional additives such as, for example, starch, mineral fillers, sizing agents, retention aids, and strengthening polymers. Among the fillers that may be used are organic and inorganic pigments such as, by way of example, polymeric particles such as polystyrene latexes and polymethylmethacrylate, and minerals such as calcium carbonate, kaolin, and talc. In addition to pulp fibers and fillers, the paper material also includes dispersed within the fibers and any other components from about 0.5 to about 5.0 wt % by dry weight expanded microspheres. More preferably the paper includes from about 1.0 to about 2.0 wt % expanded microspheres. Suitable microspheres include synthetic resinous particles having a generally spherical liquid-containing center. The resinous particles may be made from methyl methacrylate, methyl methacrylate, ortho-chlorostyrene, polyortho-chlorostyrene, polyvinylbenzyl chloride, acrylonitrile, vinylidene chloride, para-tert-butyl styrene, vinyl acetate, butyl acrylate, styrene, methacrylic acid, vinylbenzyl chloride and combinations of two or more of the foregoing. Preferred resinous particles comprise a polymer containing from about 65 to about 90 percent by weight vinylidene chloride, preferably from about 65 to about 75 percent by weight vinylidene chloride, and from about 35 to about 10 percent by weight acrylonitrile, preferably from about 25 to about 35 percent by weight acrylonitrile.

The microspheres preferably subsist in the paper web in an "expanded" state, having undergone expansion in diameter in the order of from about 300 to about 600% from an "unexpanded" state in the original papermaking furnish from which the web is derived. In their original unexpanded state, the center of the expandable microspheres may include a volatile fluid foaming agent to promote and maintain the desired volumetric expansion. Preferably, the agent is not a solvent for the polymer resin. A particularly preferred foaming agent is isobutane, which may be present in an amount ranging from about 10 to about 25 percent by weight of the total weight of the resinous particles. Upon heating to a temperature in the range of from about 80° to about 190° C. in the dryer unit of a papermaking machine, the resinous particles expand to a diameter ranging from about 30 to about 60 microns. Suitable expandable microspheres are available from Akzo Nobel of Marietta, Ga. under the tradename EXPANCEL. Expandable microspheres and their usage in paper materials are described in more detail in copending application Ser. No. 09/770,340 filed Jan. 26, 2001, the contents of which are incorporated by reference.

Papers formed according to the present invention preferably have a final caliper, after calendering of the paper, and any nipping or pressing such as may be associated with subsequent coating of from about 11.0 to about 18.0 mils, more preferably from about 14.0 mils to about 16.0 mils. Papers of the invention also typically exhibit basis weights of from about 80 lb/3000 $ft^2$ to about 300 lb/3000 $ft^2$, more preferably from about 120 lb/3000 $ft^2$ to about 150 lb/3000 $ft^2$. The final density of the papers, that is, the basis weight divided by the caliper, is typically from about 7.0 lb/3000 $ft^2$/mil to about 12.0 lb/3000 $ft^2$/mil, and more preferably from about 7.5 lb/3000 $ft^2$/mil to about 9.0 lb/3000 $ft^2$/mil. Thus, the paper has a relatively larger caliper in relation to its weight compared to conventional papers.

The reduction in basis weight versus caliper is believed to be attributable at least in part to the large number of tiny voids in the paper associated with the expanded microspheres interspersed in the fibers with the microspheres causing, especially during the expansion process, a significant increase in the void volume in the material. In addition, the paper after drying operations is calendered sufficient to achieve the final desired calipers discussed herein along with any desired surface conditioning of the web associated with the calendering operation. The impartation of a significantly increased void volume along with a relatively high caliper also has the effect of reducing the density of the paper while retaining good stiffness and other properties important for use as stock for file folders and the like.

The method of forming the paper materials of the present invention includes providing an initial paper furnish. The cellulosic fibrous component of the furnish is suitably of the chemically pulped variety, such as a bleached kraft pulp, although the invention is not believed to be limited to kraft pulps, and may also be used with good effect with other chemical pulps such as sulfite pulps, mechanical pulps such as ground wood pulps, and other pulp varieties and mixtures thereof such as chemical-mechanical and thermo-mechanical pulps.

While not essential to the invention, the pulp is preferably bleached to remove lignins and to achieve a desired pulp brightness according to one or more bleaching treatments known in the art including, for example, elemental chlorine-based bleaching sequences, chlorine dioxide-based bleaching sequences, chlorine-free bleaching sequences, elemental chlorine-free bleaching sequences, and combinations or variations of stages of any of the foregoing and other bleaching related sequences and stages.

After bleaching is completed and the pulp is washed and screened, it is generally subjected to one or more refining steps. Thereafter, the refined pulp is passed to a blend chest where it is mixed with various additives and fillers typically incorporated into a papermaking furnish as well as other pulps such as unbleached pulps and/or recycled or post-consumer pulps. The additives may include so-called "internal sizing" agents used primarily to increase the contact angle of polar liquids contacting the surface of the paper such as alkenyl succinic anhydride (ASA), alkyl ketene dimer (AKD), and rosin sizes. Retention aids may also be added at this stage. Cationic retention aids are preferred; however, anionic aids may also be employed in the furnish.

In addition, and prior to providing the furnish to the headbox of a papermaking machine, polymeric microspheres are added to the pulp furnish mixture. As noted above, the microspheres are added in an amount of from about 0.5% to about 5.0% based on the total dry weight of the furnish. The microspheres may be preexpanded or in substantially their final dimension prior to inclusion in the furnish mixture. However, it is preferred that the microspheres are initially added to the furnish in a substantially unexpanded state and then caused to expand as the paper web is formed and dried as described hereinafter. It will be appreciated that this expansion has the effect of enabling an increased caliper and reduced density in the final paper product. It is also within the scope of the invention to include mixtures of expandable and already-expanded microspheres (or microspheres that are already substantially in their final dimensional state) in the papermaking furnish so that a portion of the microspheres will expand to a substantial degree in drying operations while the balance will remain in substantially the same overall dimensions during drying.

Once prepared, the furnish is formed into a single or multiply web on a papermaking machine such as a Fourdrinier machine or any other suitable papermaking machine known in the art, as well as those which may become known in the future. The basic methodologies involved in making paper on various papermaking machine configurations are well-known to those of ordinary skill in the art and accordingly will not be described in detail herein. In general, a so-called "slice" of furnish consisting of a relatively low consistency aqueous slurry of the pulp fibers (typically about 0.1 to about 1.0%) along with the microspheres and various additives and fillers dispersed therein is ejected from a headbox onto a porous endless moving forming sheet or wire where the liquid is gradually drained through small openings in the wire until a mat of pulp fibers and the other materials is formed on the wire. The still-wet mat or web is transferred from the wire to a wet press where more fiber-to-fiber consolidation occurs and the moisture is further decreased. The web is then passed to an initial dryer section to remove most of the retained moisture and further consolidate the fibers in the web. The heat of the drying section also promotes expansion of unexpanded microspheres contained in the web.

After initial drying, the web may be further treated using a size press wherein additional starch, pigments, and other additives may be applied to the web and incorporated therein by the action of the press.

After treatment in the size press and subsequent drying, the paper is calendered to achieve the desired final caliper as discussed above to improve the smoothness and other properties of the web. The calendering may be accomplished by steel-steel calendaring at nip pressures sufficient to provide a desired caliper. It will be appreciated that the ultimate caliper of the paper ply will be largely determined by the selection of the nip pressure.

Paper materials formed according to the invention may be utilized in a variety of office or clerical applications. In particular, the inventive papers are advantageously used in forming Bristol board file folder or jackets for storing and organizing materials in the office workplace. The manufacture of such folders from paper webs is well known to those in the paper converting arts and consists in general of cutting appropriately sized and shaped blanks from the paper web, typically by "reverse" die cutting, and then folding the blanks into the appropriate folder shape followed by stacking and packaging steps. The blanks may also be scored beforehand if desired to facilitate folding. The scoring, cutting, folding, stacking, and packaging operations are ordinarily carried out using automated machinery well-known to those of ordinary skill on a substantially continuous basis from rolls of the web material fed to the machinery from an unwind stand.

Figure 3:
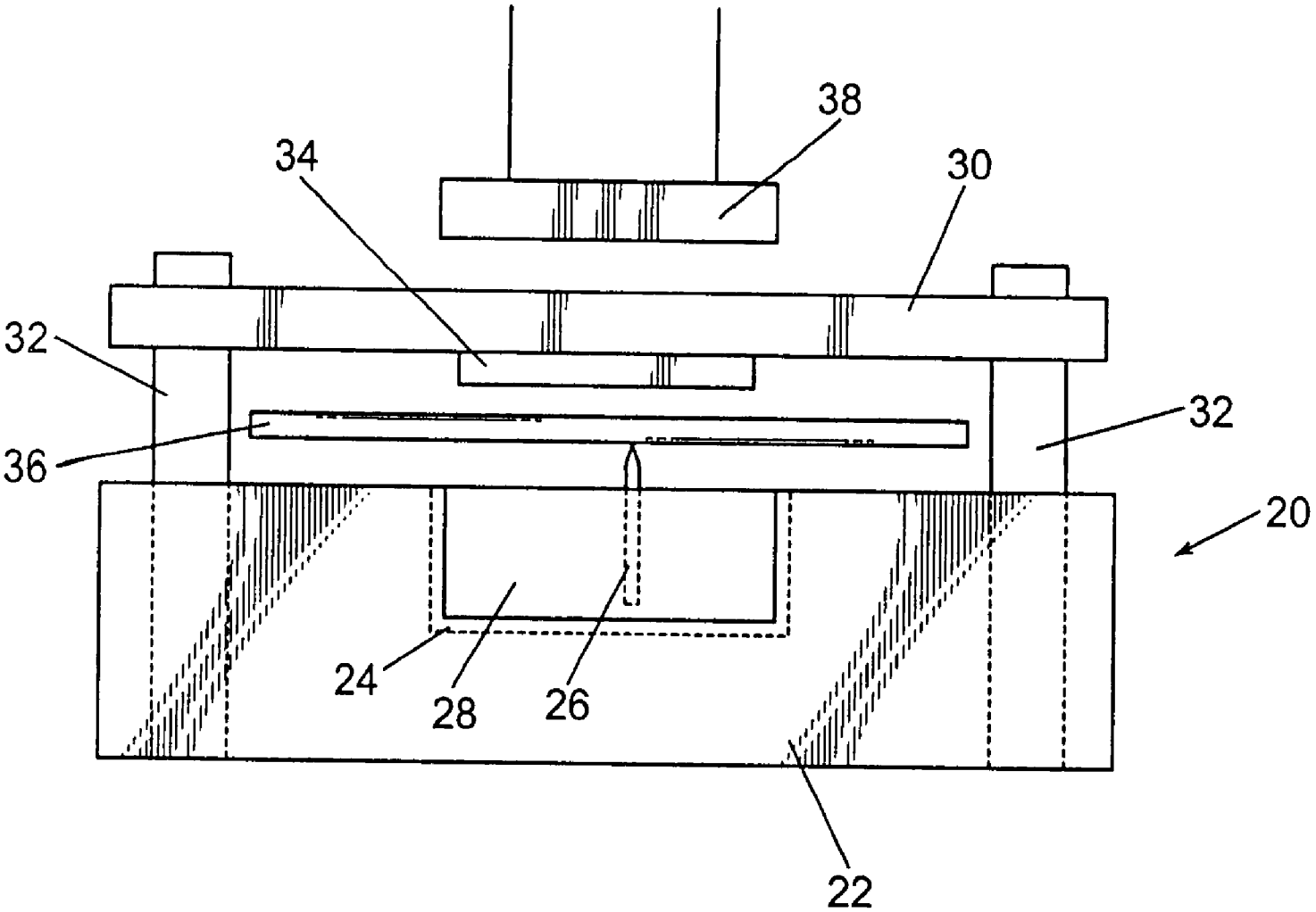
FIG. 3 is a side elevational view illustrating diagrammatically a paper die cutting apparatus for use in reverse die cutting paper samples.

A typical apparatus for "reverse" die cutting is illustrated diagrammatically in FIG. 3. Such die cutting is in contrast to so-called "guillotine" cutting of paper. In guillotine cutting, a paper to be cut is supported by a flat, fixed surface underneath the paper, and the paper is cut by the lowering of a movable cutting blade down through the thickness of the paper and into a slot in the fixed surface dimensioned to receive the cutting blade. Guillotine cutting typically produces relatively smooth paper edges; however, guillotine cutting is generally impractical for high speed, large volume cutting applications.

In reverse die cutting, a cutting blade is fixed in an upright position protruding from a housing located beneath the paper to be cut. With the blade fixed and the paper in a cutting position above the blade, a contact plate is lowered against the top of the paper and presses the paper against the edge of the cutting blade causing the blade to cut the paper.

The papers and the folders and other die cut articles formed therefrom, having exposed edges have been observed to exhibit a significantly reduced tendency to cut the skin of persons handling the folders as compared to prior art papers and die cut paper articles such as folders. That is, the edges of the papers are less likely to cause cutting or abrasion of the skin if the fingers or other portions of the body are inadvertently drawn against an exposed edge of the material.

Without being bound by theory, it is believed the improvement in cut resistance derives from the combination of an increased caliper and a decreased density as compared to prior art papers and the effect of these attributes on how the paper reacts to cutting operations. As noted above, folder blanks are typically die cut. When die cutting blanks for conventional folders from prior art papers having a relatively small caliper and a relatively high density, it is believed that the die blade initially creates a clean cut through a portion of the thickness of the paper. However, before the die blade can complete a clean cut through the paper, the remainder of the paper thickness "bursts" or fractures in a relatively jagged and irregular manner. As a consequence, the resultant edge of the folder is jagged and includes a large number of very small, but very sharp paper shards. Contact with these small jagged sharp edges and shards is believed to be a primary cause of paper cut incidents.

While the resultant paper edges from die cutting are more rough and jagged than from, say, guillotine cutting, die cutting techniques are more easily implemented in large-scale, high speed manufacturing, and are therefore favored greatly in modern practice.

FIG. 1 illustrates four samples of a conventional paper which have been cut by different techniques. The foremost sample in the micrograph is a paper which has been guillotine cut. The two samples depicted in the center of the micrograph are cut by a lab bench die cutter described in further detail hereinafter. The final sample, in the background of the micrograph, is cut by a conventional, production scale die cutter. As may be seen, the die cut conventional papers exhibit considerable roughness about the edges of the paper samples.

However, it has been determined that paper according to the invention having a relatively high caliper and relatively low density has a considerably reduced tendency to fracture or burst prematurely when being die cut. The die blade is apparently allowed to complete a clean cut through the paper thickness and, consequently, the resultant edge exhibits significantly fewer jagged irregularities and shards which produce paper cuts. Therefore, folders for example made according to the invention exhibit a significantly reduced tendency to cause paper cuts as they are being handled.

Figure 2:
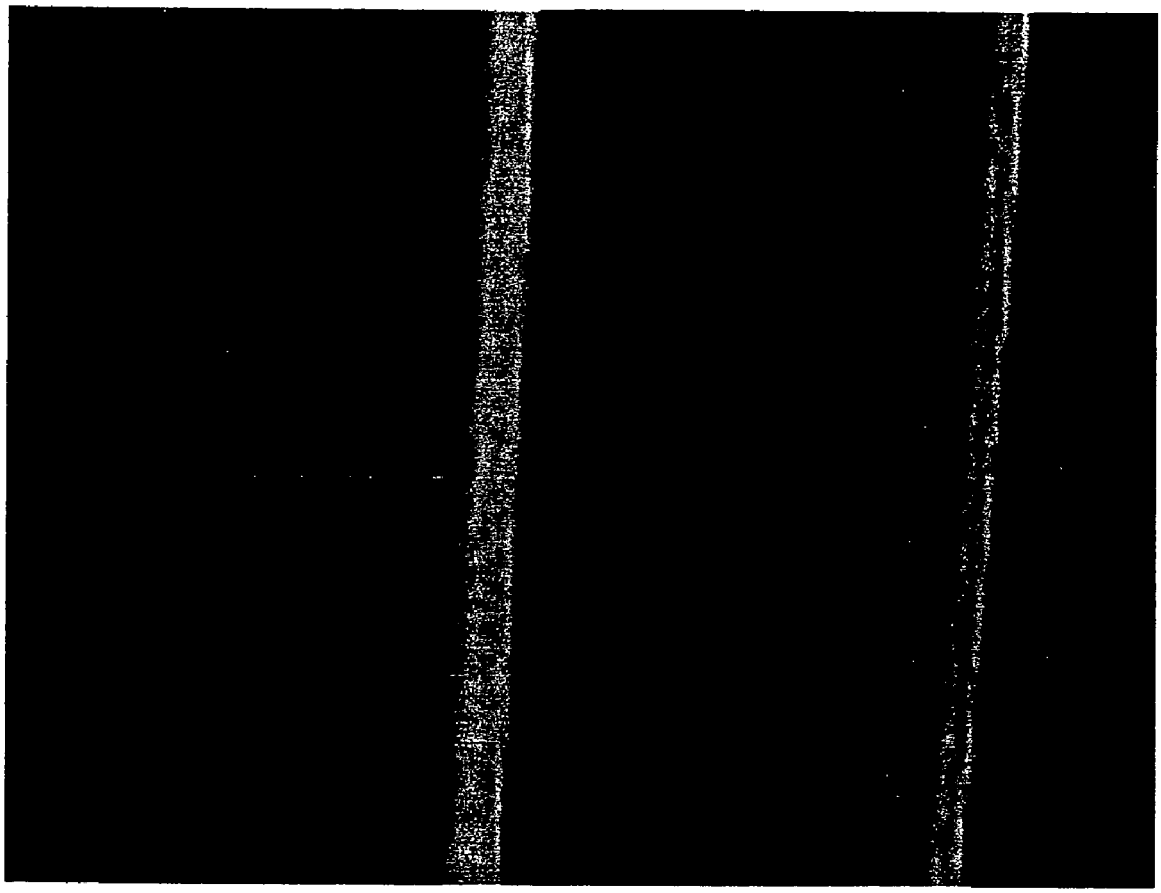
FIG. 2 is another photomicrograph comparing a die cut conventional paper and a die cut paper according to one embodiment of the present invention.

The differences in the resultant die cut paper edges is dramatically illustrated in FIG. 2 which depicts on the right a die-cut edge of paper formed according to the invention and to the left a die-cut edge of a conventional paper of substantially the same basis weight. The inventive paper includes about 2 wt % expanded microspheres and has a caliper of about 15 mils and a density of about 8.7 lb/3000 $ft^2$/mil. The conventional paper does not include any microspheres and has a caliper of about 11 mils and a density of about 11.3 lb/3000 $ft^2$/mil. It may be seen that the edge of the inventive paper is significantly smoother in appearance and has a more beveled corner profile. It is believed that these differences account for the reduction in cutting tendency.

The following nonlimiting examples illustrate various additional aspects of the invention. Unless otherwise indicated, temperatures are in degrees Celsius, percentages are by weight and the percent of any pulp additive or moisture is based on the oven-dry weight of the total amount of material.

EXAMPLE 1

A series of papers were formed from a mixture of about 40% softwood pulp and about 60% hardwood pulp and having a Canadian Standard Freeness of about 450 and incorporating amounts of expandable microspheres and being calendered to a variety of differing calipers. The resultant papers containing the expanded microspheres were then tested to determine the likelihood of an edge cutting a person's fingers while being handled. In place of actual human skin, the tests were performed using a rubberized finger covered by a latex glove material which served as an artificial "skin".

The samples for examination were die cut using a laboratory die cutter 20 illustrated in FIG. 3. The cutter includes a bottom housing 22 having a recess 24. A cutting blade 26 is mounted in a supporting block 28 and the block is fixed in the recess 24 so that the cutting blade projects upward.

The die cutter 20 also includes an upper housing 30 which is held in alignment with the lower housing by a plurality of bolts or rods 32 which are received in a corresponding plurality of holes in the upper housing 30. Over the cutting blade 26, the upper housing includes a contact surface 34. The paper sample 36 to be cut is placed in the gap between the cutting blade 26 and the contact surface 34. The contact surface 34 is then pressed downward by a hydraulic ram 38 or by other suitable driving means so that the paper sample 36 is pressed against the cutting blade and cut/burst in two.

Figure 4:
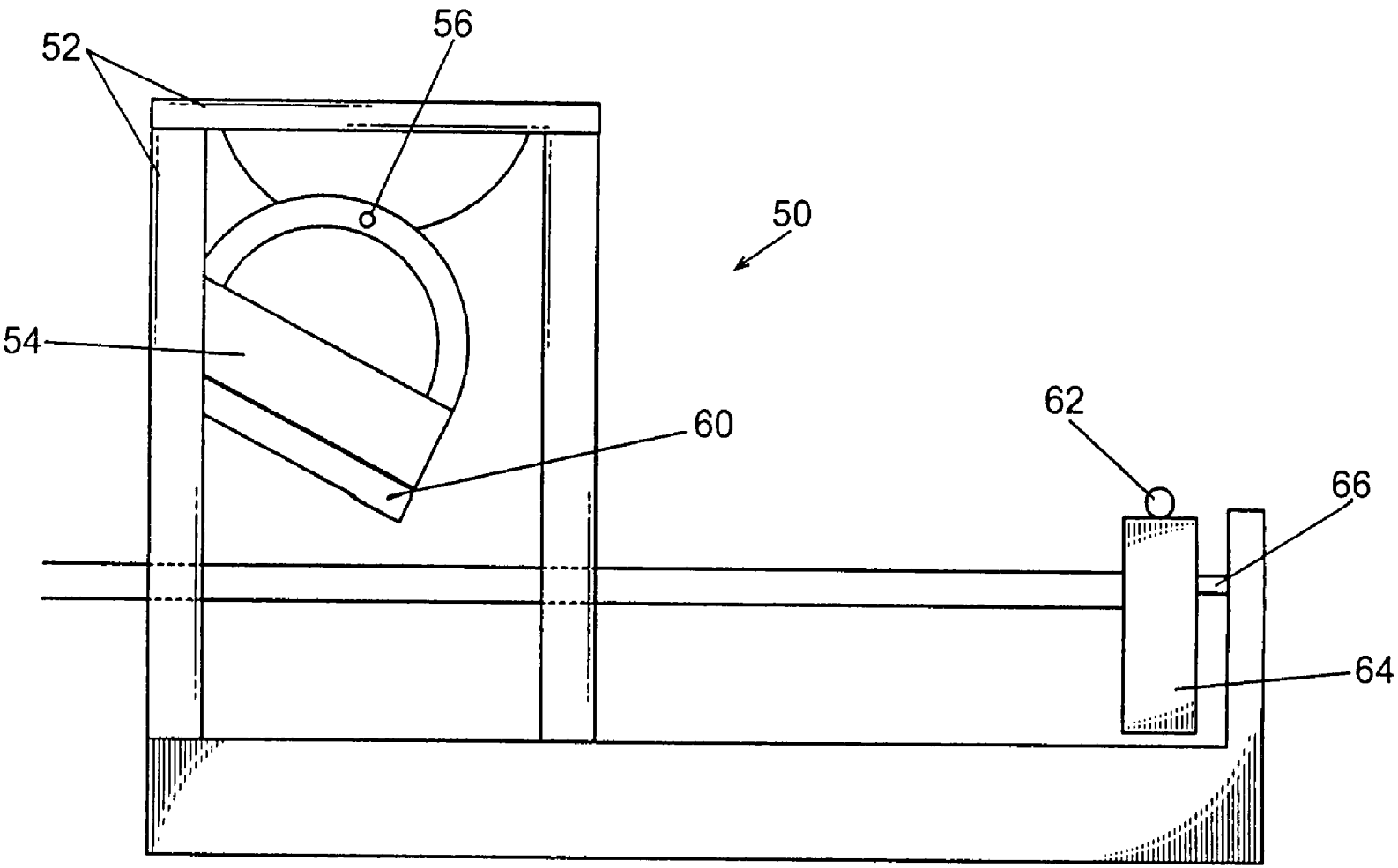
FIG. 4 is a side elevational view illustrating diagrammatically a testing apparatus for simulating paper cuts upon a finger.
Figure 5:
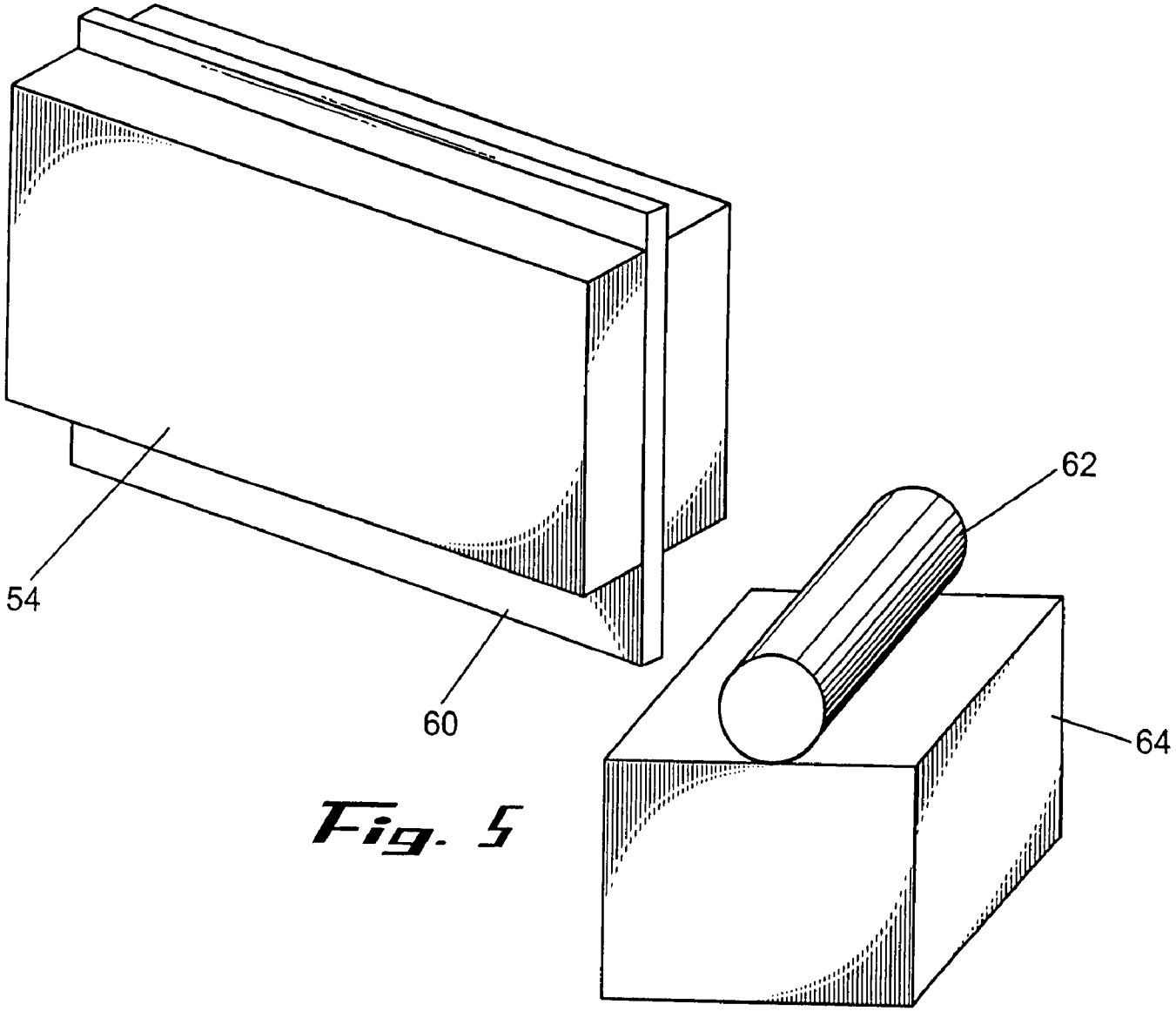
FIG. 5 is a perspective view illustrating certain aspects of the testing apparatus of FIG. 4.

The cutting tendencies of the edges of the paper samples were evaluated in a testing procedure referred to hereinafter as the "Cutting Index 30" test (with "30" indicating the number of replicates of the test performed). The Cutting Index 30 test uses an apparatus similar to that depicted diagrammatically in FIGS. 4 and 5. The testing apparatus 50 includes a frame 52 which supports a paper sample clamping device 54 and suspends the clamping device 54 from above. The clamping device 54 is suspended about a pivot point 56 which allows the angle of the clamping device 54 to vary relative to horizontal. In this manner, the paper may be contacted against the simulated finger at different contact angles. The paper sample 60 to be tested is held in the clamping device 54 in a substantially upright position.

The testing apparatus 50 also includes a simulated finger 62 which may be drawn against the edge of the paper sample 60 in the apparatus. For instance, the finger 62 may be removably affixed to a movable base 64 which slides along a rail or track 66 by means of hydraulic actuation so that the finger 62 is drawn into contact with the edge of the paper sample 60. After the sample contacts the finger, the latex is examined to determine if a cut is produced and the cuts are then characterized according to size.

The simulated finger is preferably formed from an inner rod of metal or stiff plastic, which is covered by a somewhat flexible material such a neoprene rubber and the neoprene layer is preferably covered by a latex layer such as a finger from a latex glove. In this manner, the finger roughly simulates the bone, muscle, and skin layers of an actual finger. While the latex and neoprene structure does not exhibit the exact some tendency to be cut as an actual finger, it is believed that a relatively high incidence of cuts in this structure will generally correlate to a relatively high incidence of cuts in an actual finger and a relatively low incidence of cuts in this structure will generally correlate to a relatively low incidence of cuts in an actual finger.

In the experiments described herein, neoprene rubber layer employed has a hardness of about Shore A 50, the latex "skin" is about 0.004 inches thick, and the latex skin is attached to the neoprene using double-sided tape. In order to better simulate skin, the latex is also allowed to condition by exposure to an elevated temperature of about 125° C. for a period of about 6 hours prior to testing. Because latex is a naturally occurring substance, latexes and products produced therefrom exhibit some degree of variation from batch to batch with respect to certain properties such as moisture content. It was found that by conditioning the latex at the elevated temperature for about 6 hours, the resultant latex skins exhibited a more uniform set of properties and accordingly the reproducibility of test results improved.

The paper samples employed are cut to a size of about 1 inch by six inches and a die cut edge is aligned in the bottom of the clamping device to contact the finger. The simulated finger is then drawn against the paper edge, then stopped and the latex skin is examined to determine if a cut has occurred and if so, the magnitude or size of the cut.

A total of 30 replicates were performed for each paper sample. The results were as follows:

TABLE I

| Sample ID (WMCF) | % Expancel (Wt %) | Basis weight (lb/3000 ft2) | Final Caliper (mils) | Density (lb/3000 ft2/mil) | Total Cuts | Cutting Index |
|---|---|---|---|---|---|---|
| 1A | 0 | 127 | 11.9 | 10.7 | 19 | 45 |
| 2 | 2 | 108 | 12.0 | 9.0 | 15 | 34 |
| 3 | 3 | 108 | 12.7 | 8.5 | 17 | 29 |
| 6A | 0 | 148 | 12.1 | 12.3 | 22 | 56 |
| 6B | 0 | 182 | 14.5 | 12.6 | 18 | 30 |
| 6C | 0 | 200 | 16.2 | 12.4 | 13 | 16 |
| 124 | 2 | 131 | 15.8 | 8.3 | 7 | 15 |
| 143 | 2 | 143 | 17.0 | 8.4 | 3 | 5 |

In addition to measuring the number of cuts (out of 30 replicates), the size of each cut was characterized on a 1 to 5 scale with 1 being "very small" and 5 being "large". Using this data, a "Cutting Index" was determined by summing the products of the number of cuts in each size category by the severity of the cut on the 1 to 5 scale. These results are shown in Table II:

TABLE II

| Sample ID | Total Cuts | Large (5) | Med+ (4) | Med (3) | Small (2) | V. Small (1) | Cutting Index |
|---|---|---|---|---|---|---|---|
| 1A | 19 | 0 | 3 | 5 | 7 | 4 | 45 |
| 2 | 15 | 0 | 1 | 3 | 10 | 1 | 34 |
| 3 | 17 | 0 | 0 | 1 | 10 | 6 | 29 |
| 6A | 22 | 0 | 4 | 8 | 6 | 4 | 56 |
| 6B | 18 | 0 | 0 | 6 | 0 | 12 | 30 |
| 6C | 13 | 0 | 0 | 0 | 3 | 10 | 16 |
| 124 | 7 | 0 | 0 | 3 | 2 | 2 | 15 |
| 143 | 3 | 0 | 0 | 0 | 2 | 1 | 5 |

As may be seen in samples 1-3 and 6A, the density of the papers was varied by addition of varying amounts of expanded microspheres while the paper calipers were held approximately constant at about 12 mils. These samples demonstrate that a reduction of density associated with inclusion of microspheres leads to a corresponding reduction in the number and severity of cuts produced by the paper.

In samples 6A-6C, the paper density was held approximately constant at about 12.5 lb/3000 $ft^2$/mil while the caliper of the papers was varied. The results demonstrate a clear correlation between increasing caliper and decreasing cuts and cut severity in a paper containing the microspheres.

Finally, in samples 124 and 143, papers were produced containing microspheres and employing both a reduced density and a high caliper at the same time. The results were quite dramatic with number of cuts and the weight average cuts both being reduced to extremely low levels. Thus, it appears that while both caliper increase and density reduction in association with addition of microspheres may individually reduce cutting to some degree, the combination of the two appears to provide a synergistic reduction in cutting which is surprising and quite unexpected.

EXAMPLE 2

A similar set of tests were conducted using a series of papers formed from a second pulp furnish, again formed from a mixture of about 40% softwood pulp and about 60% hardwood pulp and having a Canadian Standard Freeness of about 450. In these tests, two sets of papers were produced, with each set of papers having approximately the same basis weight. For one group of papers, the basis weight was on the order of about 130 lb/3000 $ft^2$ and for the second group, the basis weight was about 150 lb/3000 $ft^2$. Within each group, various amounts of microspheres were added and the resultant paper caliper varied. Again, 30 replicates of each sample were tested for cutting tendency. The results are shown in Tables III and IV.

TABLE III

| Sample ID | % Expancel (Wt %) | Basis weight (lb/3000 ft2) | Final Caliper (Mils) | Density (lb/3000 ft2/mil) | Total Cuts | Cutting Index |
|---|---|---|---|---|---|---|
| 1 | 0 | 129 | 12.1 | 10.7 | 21 | 77 |
| 3 | 2 | 133 | 15.5 | 8.58 | 15 | 34 |
| 4 | 3 | 128 | 17.2 | 7.46 | 10 | 16 |
| 5 | 0 | 153 | 13.8 | 11.1 | 25 | 80 |
| 7 | 2 | 149 | 14.6 | 10.2 | 16 | 36 |
| 8 | 3 | 150 | 18.4 | 8.15 | 7 | 12 |

These results show a clear trend toward decreases in total cuts as well as the weighted average cuts with increasing amount of microspheres where the basis weight is held about the same. It is seen that increasing the amount of microspheres while holding the basis weight the same can be said to result in an increased caliper, decreased density, and decreased number and severity of cuts.

TABLE IV

| Sample ID | Total Cuts | Large (5) | Med+ (4) | Med (3) | Small (2) | V. Small (1) | Cutting Index |
|---|---|---|---|---|---|---|---|
| 1 | 21 | 7 | 5 | 5 | 3 | 1 | 77 |
| 3 | 15 | 0 | 2 | 1 | 8 | 3 | 34 |
| 4 | 10 | 0 | 0 | 0 | 6 | 4 | 16 |
| 5 | 25 | 2 | 9 | 6 | 8 | 0 | 80 |
| 7 | 16 | 0 | 0 | 4 | 12 | 0 | 36 |
| 8 | 7 | 0 | 0 | 0 | 5 | 2 | 12 |

EXAMPLE 3

A similar set of tests were conducted using a series of papers formed from a third pulp furnish including about 35% softwood fibers and about 65% hardwood fibers. Again, 30 replicates of each sample were tested for cutting tendency. The results are shown in Tables V.

TABLE V

| Sample ID | % Expancel (Wt. %) | Basis weight (lb/3000 ft2) | Final Caliper (Mils) | Density (lb/3000 ft2/mil) | Total Cuts | Cutting Index |
|---|---|---|---|---|---|---|
| 124 lb control | 0 | 129 | 11.39 | 11.34 | 28 | 116 |
| 143 lb control | 0 | 148 | 11.57 | 12.76 | 30 | 95 |
| 4 | 2 | 128 | 14.83 | 8.61 | 15 | 21 |
| 6 | 2 | 125 | 15.21 | 8.22 | 7 | 9 |
| 7 | 2 | 124 | 14.94 | 8.28 | 5 | 5 |
| 8 | 2 | 125 | 15.08 | 8.27 | 15 | 15 |
| 9 | 2 | 125 | 14.56 | 8.62 | 8 | 9 |

In these tests, the papers containing expanded microspheres were produced to provide a target basis weight of about 124 lb/3000 $ft^2$ and compared to two controls formed with no microspheres and having basis weights of 124 lb/3000 $ft^2$ and 143 lb/3000 $ft^2$ respectively. The expanded microsphere samples again showed dramatic reductions in cutting tendency as compared to the control papers. The total number of cuts was reduced by about 50% or more in each case and the reductions in average weighted cuts was reduced further still.

Having now described various aspects of the invention and preferred embodiments thereof, it will be recognized by those of ordinary skill that numerous modifications, variations and substitutions may exist within the spirit and scope of the appended claims.

What is claimed is:

1. A paper substrate, comprising cellulosic fibers and from 0.5 to 5.0 wt % of microspheres based upon the total weight of the substrate on a dry basis, wherein said substrate has a density of from 7.0 to 12.0 lb/3000 $ft^2$/mil and reverse die cut edges which exhibit improved resistance to inflicting cuts upon human skin.

2. The paper substrate according to claim 1, wherein the microspheres comprises synthetic polymeric microspheres.

3. The paper substrate according to claim 1, wherein the expanded microspheres are made from at least one material selected from the group consisting of methyl methacrylate, ortho-chlorostyrene, polyortho-chiorostyrene, polyvinylbenzyl chloride, acrylonitrile, vinylidene chloride, para-tert-butyl styrene, vinyl acetate, butyl acrylate, styrene, methacrylic acid, and vinylbeazyl chloride.

4. The paper substrate according to claim 1, wherein the fibers comprise at least 30 wt % softwood fibers by weight dry basis.

5. The paper substrate according to claim 1, wherein the fibers comprise not morc than 70 wt % hardwood fibers by weight dry basis.

6. The paper substrate according to claim 1, wherein said substrate has a Cutting Index of less than 40 when analyzed according to the Cutting Index 30 test.

7. The paper substrate according to claim 1, wherein said miorospheres are expanded, unexpanded, or mixtures thereof.

8. The paper substrate according to claim 1, wherein said microspheres comprise at least one volatile fluid.

9. The paper substrate according to claim 1, wherein said microspheres are dispersed within the cellulosic fibers.

10. The paper substrate according to claim 1, wherein the substrate is a folder or jacket.

11. The paper substrate according to claim 1, wherein the substrate is calendared.

12. The paper substrate aocordihg to claim 1, wherein said substrate has a caliper of from 11.0 to 18.0.

13. A method of making the paper substrate according to claim 1, comprising contacting said cellulosic fibers with said microspheres.

14. The method according to claim 13, comprising contacting said cellulosic fibers wit said microspheres at prior to a headbox of a papermaking machine.

15. The method according to claim 13, wherein the microspheres are expanded, unexpanded, or mixtures thereof.

16. The method according to claim 13, further comprising drying said substrate.

17. The method according to claim 13, further comprising calendaring said substrate.

18. A paper substrate, comprising cellulosic fibers and from 0.5 to 5.0 wt % of microspheres based upon the total weight of the substrate on a dry basis, wherein said substrate has a caliper of from 11.0 to 18.0 and reverse die cut edges which exhibit improved resistance to inflicting cuts upon human skin.

19. The paper substrate according to claim 18, wherein the microspheres comprises synthetic polymeric microspheres.

20. The paper substrate according to claim 18, wherein the expanded microspheres are made from at least one material selected from the group consisting of methyl methacrylate, ortho-chlorostyrene, polyortho-chiorostyrene, polyvinylbenzyl chloride, acrylonitrile, vinylidene chloride, para-tert-butyl styrene, vinyl acetate, butyl acrylate, styrene, methacrylic acid, and vinylbenzyl chloride.

21. The paper substrate according to claim 18, wherein the fibers comprise at least 30 wt % softwood fibers by weight dry basis.

22. The paper substrate according to claim 18, wherein the fibers comprise not more than 70 wt % hardwood fibers by weight dry basis.

23. The paper substrate according to claim 18, wherein said substrate has a Cutting Index of less than 40 when analyzed according to the Cutting Index 30 test

24. The paper substrate according to claim 18, wherein said microspheres are expanded, unexpanded, or mixtures thereof.

25. The paper substrate according to claim 18, wherein said microspheres comprise at least one volatile fluid.

26. The paper substrate according to claim 18, wherein said microspheres are dispersed within the cellulosic fibers.

27. The paper substrate according to claim 18, wherein the substrate is a folder or jacket.

28. The paper substrate according to claim 18, wherein the substrate is calendared.

29. The paper substrate according to claim 18, wherein the substrate has a density of from 7.0 to 12.0 lb/3000ft $^2$ mil.

30. A method of making the paper substrate according to claim 18, comprising contacting said cellulosic fibers with said microspheres.

31. The method according to claim 30,comprising contacting said cellulosic fibers with said microspheres at prior to a headbox of a papermaking machine.

32. The method according to claim 30, wherein the microspheres are expanded, unexpanded, or mixtures thereof.

33. The method according to claim 30, further comprising drying said substrate.

34. The method according to claim 30, comprising calendaring said substrate.

* * * * *